United States Patent [19]

Bubley

[11] Patent Number: 4,724,760

[45] Date of Patent: Feb. 16, 1988

[54] SCREEN PRESS WITH CONTROLLED STOP GENEVA MECHANISM

[75] Inventor: Henry J. Bubley, Deerfield, Ill.

[73] Assignee: American Screen Printing Equipment Company, Chicago, Ill.

[21] Appl. No.: 884,540

[22] Filed: Jul. 11, 1986

[51] Int. Cl.[4] ..... B41F 15/10

[52] U.S. Cl. ..... 101/115; 101/129; 74/436

[58] Field of Search ..... 101/115, 129; 74/436, 74/84 R

[56] References Cited

U.S. PATENT DOCUMENTS 2,512,894 6/1950 Gieskieng ..... 74/436
4,099,460 7/1978 Bubley et al. ..... 101/115 X

FOREIGN PATENT DOCUMENTS 580390 11/1977 U.S.S.R. ..... 74/436
855296 8/1981 U.S.S.R. ..... 74/436

*Primary Examiner*—Clifford D. Crowder
*Attorney, Agent, or Firm*—Fitch, Even, Tabin & Flannery

[57] ABSTRACT

A screen printing apparatus having a rotatable turret with a plurality of work supports is indexed by a curved geneva mechanism to each of a plurality of index positions. The curved geneva mechanism includes a plurality of curved slots having surfaces engaged by the driver with the curved slots designed to minimize the maximum amount of inertia and to maximize the available time for deceleration of the turret to provide a smoother and slower stopping of the turret and registration without banging and jarring of the apparatus. The preferred curved slots have a modified sine wave characteristic to provide slower changes in velocity during the stopping. The amount of inertia change during the indexing motion is analyzed and the curved slots are generated to eliminate abrupt changes in inertia that would result in a rough movement.

10 Claims, 6 Drawing Figures

SCREEN PRESS WITH CONTROLLED STOP GENEVA MECHANISM

This invention relates to a rotary indexing mechanism for machines using a Geneva mechanism for indexing and, more particularly, to a screen printing apparatus having a turret or turntable which is indexed by a Geneva mechanism.

BACKGROUND OF THE INVENTION

A conventional screen printing apparatus for multicolor printing on cut piece textile goods or garments is disclosed in U.S. Pat. No. 4,099,460, which is hereby incorporated by reference as if fully reproduced herein. As disclosed in this patent, the multi-color, textile screen printing apparatus has a number of arms or spiders each of which carries a platen supporting the textile piece for travel in a circular path past each of a plurality of printing machines each of which has a screen and squeegee for applying a coating of a different color or impression to the workpiece when the textile piece is at a given station. Typically, the number of printing machines varies from about four to eight. In order for each of the different colors to be registered with a preceding or succeeding color or impression, the turntable is precisely located and stopped in a registered position by a registering means such as a fork which engages a locking pin on the turntable so that the turntable is precisely locked in position at the termination of each of the arcuate indexing movement of the turntable.

In the aforementioned patent, the indexing mechanism which turns the turntable includes a conventional Geneva mechanism which has a wheel or indexer having a plurality of straight radially extending slots therein to receive a drive roller or pin mounted on the end of a rotatable drive arm which is driven by an electric motor through a gear box mechanism. A cam operated switch means cooperates in conjunction with the movement of the turntable to operate limit switches to control the printing cycle of the printing machines after the turntable has been indexed and registered.

While the aforementioned conventional Geneva mechanism works satisfactorily, particularly for smaller sizes of printing machines and for turntables of a relatively small diameter, the momentum of the larger diameter turntables makes it difficult to stop the indexing movement with conventional sizes of motors and gear boxes. The load on the motors and gear boxes to stop the turntable becomes excessive. For instance, the typical sizes os screens printed with the systems of the aforementioned patent had platens with textile supported thereon which were printed by screens having a maximum size of 22×22 inches. In many instances, it is desired, but it is not economically feasible at this time, to have larger radius arms and to have larger size platens which will cooperate with printers having screens of 25×38 inches, 30×40 inches, and even larger. Of course, with the bigger screens and bigger arms for supporting the larger sizes of textile goods, the momentum and the amount of energy to be dissipated during deceleration is increased particularly with the machines printing four to eight different colors.

The turntables are indexed through relatively small increments usually ranging from 90° for a four-color machine having four indexes per revolution to 45° for an eight color machine having eight indexing increments per revolution. For each of the indexing movements, there must be an initial acceleration from a dead stop and then a deceleration to again a dead stop. The controlling of the stopping momentum of the arms and turntable has been a problem which has been addressed in different manners including the use of mechanical brakes, which are very hard to set and to adjust properly, so that the brakes wil dissipate the energy needed to decelerate the indexer and to stop it precisely. Other approaches for smaller size machines have used electrical controls for the motor but this has been found not to be satisfactory for larger sizes of turntables.

U.S. Pat. No. 4,099,460 uses the conventional Geneva mechanism having the straight line slots and driver roller on the crank arm in which the first half of the roller engagement with the slot in the wheel of the indexing cycle is used to accelerate the turntable from a dead stop to its maximum velocity and then the second half of the indexing cycle is used by the drive roller and slot to slow down and stop the turntable movement. Thus, there is fifty per cent division of time and movement for starting and stopping with the conventional Geneva mechanism. During this deceleration, a relatively high torque, for example, 20,000 inch-pounds is generated on the gear box for small presses. The usual limitation of the size of the screen printing apparatus is the maximum inertia that will be generated and then dissipated by the gear box and motor when stopping the indexing.

With the fine registration needed for multi-color screen printing, the turntable needs to be decelerated slowly as it arrives at the stop position and then it needs to be stopped precisely at the stop position. If the turntable is not decelerated slowly or if the turntable is not precisely stopped, the registering means is often subjected to shock and jarring which leads to maintenance problems and breakage if the stopping is with a hard jarring and from high force engagement of the registering fork and pin. Also such hard, fast stops having a tendency to throw off the registration.

In addition to solving the problem of dissipating the momentum forces used for large size turntables in screen printing machines, it is preferred that the apparatus be very predictable first, as to the position of the turntable at all times; secondly, as to maximum torques generated for a wide variety of sizes of spider arms; and thirdly, as to a number of different variables including the size of the printing screens and the number of different printing stations ranging from four to eight.

In accordance with the present invention, there has been provided a new and improved Geneva mechanism for use with screen printing apparatus having a rotatable turntable in which the stopping is controlled slowly and over a longer period of time than with a conventional Geneva mechanism.

As will be described herein in greater detail, the preferred apparatus accelerates the turntable more quickly and displaces the turntable through one half of its angular movement much earlier in the indexing cycle and then uses the second half of the indexing cycle period to decelerate the turntable more slowly and over a smaller displacement to a slow stop.

Also, as will be explained hereinafter, the indexing means is very predictable and reproducable and allows computation of the maximum momentum and torque loads as well as an X by Y displacement location of the indexer and its velocity during the indexing cycle.

Accordingly, a general object of the present invention is to provide a new and improved screen printing apparatus having an indexable turntable which must be accelerated and stopped a plurality of times through each revolution.

Another and more specific object of the invention is to provide a multi-color textile printer with an improved indexing control mechanism having a curved slot Geneva mechanism operable to provide a longer deceleration time for the turntable.

These and other objects and advantages of the invention will become apparent from the following detailed description taken in connection with the accompanying drawings in which:

DETAILED DESCRIPTION OF THE DRAWING

DETAILED DESCRIPTION OF THE PREFERRED EMBODIMENT

Figure 2:
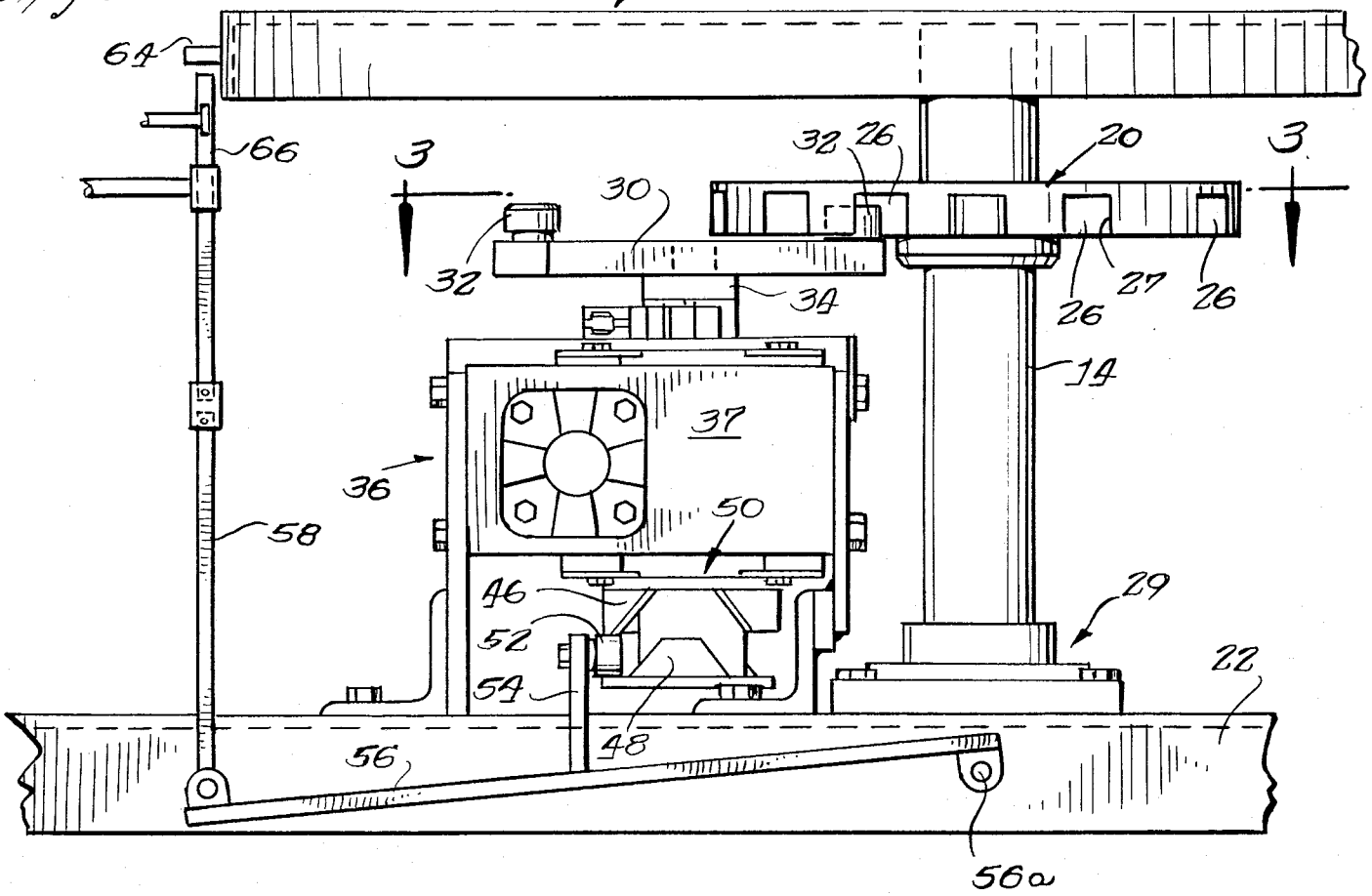
FIG. 2 is a fragmentary side elevational view of a Geneva mechanism used to drive a turntable.

As shown in the drawings for purposes of illustration, the invention is embodied in a screen printing apparatus of a multi-color kind which includes a turret or turntable assembly 12 having a turntable 24 mounted for turning about a central shaft or axis 14 which is disposed vertically in this instance. The turntable has work carriers or platens 28 rotated consecutively past each of a series of silk screen printing machines 15*a*, 15*b*, 15*c* and 15*d*. Each of the illustrated printing machines has a printing screen 16 and a reciprocating squeegee mechanism 21 for printing onto the textile workpiece which will be mounted on the platens. As best seen in FIG. 2, the turntable assembly 12 includes a large central drive wheel 20 fixed to an upper end of the central shaft 14 at a location below the turntable 25. Thus, the turntable and wheel are fixed to and rotate with the shaft 14 about the vertical axis through the shaft which is journaled for rotation in bearings 29 held on base 22 for the machine.

Figure 3:
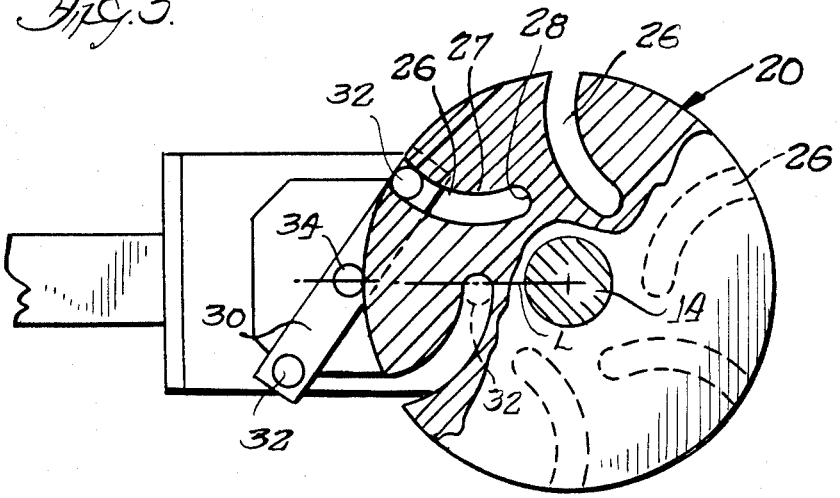
FIG. 3 is a reduced size sectional view taken substantially along the line 3—3 of FIG. 2 showing a curved slot Geneva mechanism.

As best seen in FIG. 3, the wheel 20 is provided with a plurality of slots 26 and the slots 26 receive therein a driver or driver roller 32 which is mounted on a rotatable drive arm 30. Herein, a pair of drive rollers 32 are mounted 180° apart on the drive arm 30. The latter is mounted for rotation about a vertical drive shaft 34 to bring the drive roller 32 into driving engagement with sidewalls 27 of the slots 26 on the wheel. Herein, the drive pin or drive rollers 32 project upwardly from the drive arm 30 to seat within the slot 26 of the wheel 20, as best seen in FIG. 2. The top of the wheel 20 includes a planar surface which closes the top of the slots 26. As shown in FIG. 3, the drive arm 30 rotates in a clockwise direction and the roller 32 enters the slot 26 engages the slot wall 27 and drives the wheel 20 in a counterclockwise direction. The illustrated drive arm 30 is driven by a varible speed motor 36 which includes a gear box 37 kind of speed reduction device which produces the power output at the shaft 34 at the selected speed.

Figure 6:
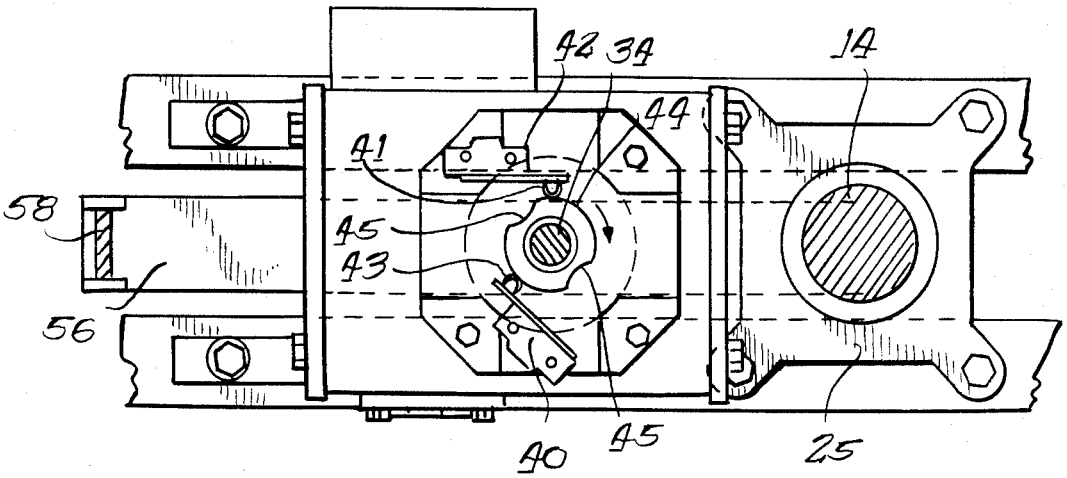
FIG. 6 is a sectional viewing showing a cam and switch operated thereby.

In FIG. 6 of U.S. Pat. No. 4,099,460, the slots shown in the wheel are each straight line slots which are radially directed toward the central rotating axis of the shaft 14. In the conventional Geneva mechanism, the dirve roller engages slot walls and turns the wheel with the wheel receiving an initial acceleration through the first one half of the turning of the wheel 20 which will be 30°, in this instance, where there are six slots. Then, in the remaining 30° of engagement of the drive roller 32 with the slot walls, the turntable is decelerated from its maximum velocity which occurs when the driver 32 is directly aligned on a theoretical line extending between the rotational axes of the shaft 14 and the shaft 34. The nature of the slow-down deceleration through this 30° is particularly accompanied by a very rapid deceleration which sometimes causes a banging or a jarring which is hard on the equipment and which sometimes causes a loss of registration or preventing the registering mechanism from operating effectively so as to assure a precise registration at each of the stations. In this conventional Geneva mechanism, the drive roller enters and exits through a common slot end on the periphery of the indexer wheel.

In accordance with the present invention, there is provided a new and improved Geneva mechanism which has a curved slot 26 which is precisely dimensioned and controlled such that the wheel 20 is accelerated faster to its maximum velocity in less than 50 percent of the indexing movement and over a shorter period of time i.e., less than 50 per cent of the indexing time period leaving the deceleration to occur with a substantially less displacement of the wheel 20 during the second half of the driver's travel through the curved slot. Because the displacement of the wheel may be, for example, 80% during the first half of the driver's movement into the curved slot thereby leaving only 20% of the wheel's displacement to occur over the second half of driver's movement, there can be a slower deceleration of the wheel to avoid the quick stop and jarring of the straight slot type of Geneva mechanism. Preferably, the displacement of the wheel terminates before the driver 32 leaves the curved slot 26 as will be explained hereinafter.

Figure 4:
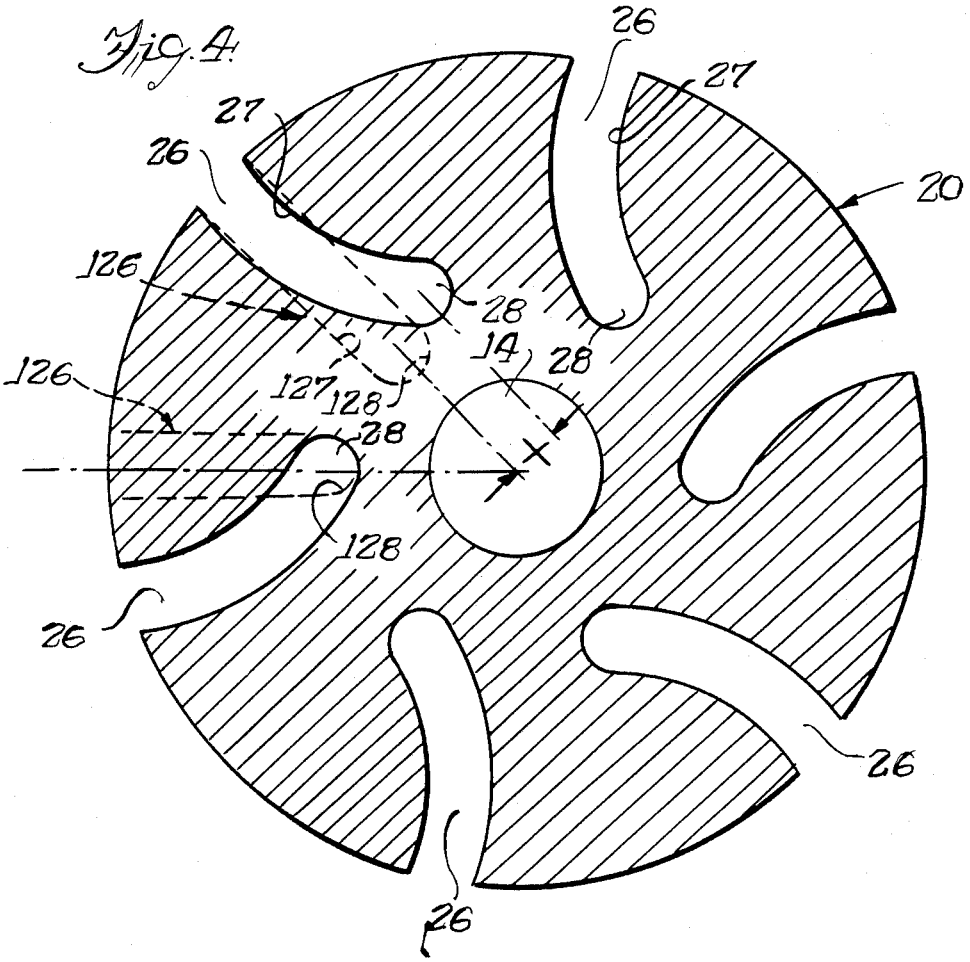
FIG. 4 is a view illustrating the curved slots in the indexer.
Figure 5:
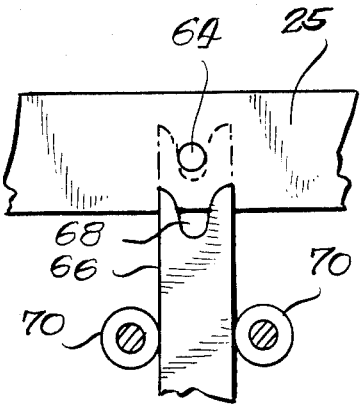
FIG. 5 is a fragmentary view of a fork moving into locking engagement with a registering pin on the turntable.

In order to compare the movement of the curved slot Geneva mechanism with the straight radial slot Geneva mechanism of the prior art, straight line slots 126 have been drawn in phantom lines on the Geneva wheel 20 in FIG. 4. The slots 26 are formed with curved walls 27 extending inwardly to an inner slot end wall 28 and the slots 126 have straight walls 127 extending radially inwardly to inner slot end walls 128. It will be seen that the end wall 28 trails the end wal 128, i.e., the end wall is displaced rearwardly in the counterclockwise direction of wheel travel by a displacement distance "X". When the driver 32 has moved through one half of its movement in a slot 26 or 126, the driver 32 is aligned on a straight line "L" shown in FIG. 3 between the axes of the wheel shaft 14 and the driver shaft 34 and the driver 32 has penetrated to its deepest position in the slot which is a position closely adjacent the end wall 28 for this curved slot Geneva mechanism and which is a position closely adjacent the end wall 128 in the straight line conventional Geneva. With curved slots 26 in the wheel 20, the wheel will, however, have been turned through an additional incremental movement in the clockwise direction equal to the displacement "X" than will the conventional Geneva mechanism having straight line radial slots. It will be seen that looking at the line "L" in FIG. 4, that the curved slot 26 slopes away from the driver 32 when it is at its deepest penetration. That is, the slot curves forwardly in the direction of rotation such that while the driver is traveling outwardly toward the periphery of the wheel, it wil be camming against the walls 27 and displacing the wheel 20 significantly less than it would for a straight line slot 126. Because the total displacement for the straight line slot 126 and for the curved slot 26 in turning the wheel 20 through 60° of travel are equal, then during this second half of travel of the driver 32 in an outward direction in the straight slot 126, the driver must push the wheel 20 through a displacement distance "X" greater than does the driver in the curved slot 26. Also, in the straight line slot 126, the displacement is substantially linear and occurring right up to the moment that the driver leaves the slot 126 whereas in the curved slot the driver may not be doing any displacement of the wheel for the last few degrees of its travel as the driver leaves the curved slot 26. Thus, the wheel may be decelerated and coast to a stop with the curved slot Geneva mechanism.

The curved slot 26 may be precisely computed and drafted and curved in accordance with the crank rotation so that the displacement of the inertia wheel 20 is moved through the desired displacements to provide the faster acceleration and the longer deceleration. As will be explained, the preferred movement of the turntable through its indexing positions is like that of a sine wave.

The curve for the slot 26 is generated by assumptions such as what percentage of the wheel displacement should occur by the time the driver 32 is aligned with the axes of the shafts 14 and 34 and is in a straight line position with them. Present experience has shown that the displacement of the wheel may be as much as 80% during the first half of the driver movement in the curved slot. The maximum velocity is achieved when the crank driven roller 32 is aligned in a straight line with the axes of the shafts 14 and 34, as shown in dotted lines in FIG. 3. The crank position for each of a number of positions in X and Y coordinates is generated and the inertia change and the indexer wheel movement and the momemtum of the indexer wheel are calculated. An analysis of the inertia change will give an understanding of what size or power the electric motor 37 must be and the mnomemtum will show the maximum forces that will be applied to the gear box and the energy load that must be dissipated to stop the indexer wheel turning movement.

In accordance with an important aspect of the present invention, the maximum momentum can be readily calculated and can be limited by changing the various variables so that the gear box 37 is not overloaded as to cause its failure or excessive wear due to high loads applied thereto during the stopping of the indexing movement. By way of example, there is provided in Table 1, a samaple of a curved slot plotted for a machine of the type shown herein but which has eight arms and eight indexes per revolution. Each spider arm has a length of 60 inches and the bearing diameter at the central shaft 14 being 1.25 inches. The number of indexes per hour is 1,000, and the radius of the wheel is 12 inches and the radius of rotation for the crank arm and its drive roller 32 is 4.97 inches. The difference between the centerlines of the crank shaft 14 and the driver shaft 34 is 12.9887 inches. In the example given in Table 1, the percentage of the indexing movement during the inward travel of the driver to the slot end eall 28 is 60 percent. Table 1 lists in "X and Y" coordinates the location of crank roller 32, and hence, the point on the slot wall 27 at which the roller 32 is in engagement for each of a large number of successive positions labeled from 69 through 135. Table 1 also lists the "inertia change", the "indexer movement", and, "momentum", at each crank rotation position. At crank rotation position 89, the inertia change reaches 2093. Beginning at crank rotation position 125, it will be seen that the slow down of the wheel is taking place very quickly and that through the last positions of 128–135 the wheel 20 is essentially at its registered position even though the roller 32 has not yet left the slot 26. The "zero" in the several columns at the end of the Table 1 shows almost no movement of the wheel 20 at the end as it coasts into the registering position.

TABLE 1

Spider Arm: Length 60 inches
Bearing Diameter + 1.25 inch
% of Index to Stop = .6
Number of Indexes Per Hour = 1000
Radius of the Geneva = 12 inches
Radius of the Crank = 4.97055809 inches
Crank Centerline To Shaft Centerline = 12.9887046 inches

| CRANK ROTATION | X | Y | INERTIA CHANGE (inch lbs) | INDEXER MOVEMENT (inch) | MOMENTUM (inch lbs$^2$) |
|---|---|---|---|---|---|
| 69 | 7.407 | −1.505 | −214291 | .76 | 214191 |
| 70 | 7.419 | −1.394 | 146081 | .429 | 68210 |
| 71 | 7.433 | −1.369 | 2196 | .422 | 66014 |
| 72 | 7.449 | −1.344 | 1595 | .417 | 64419 |
| 73 | 7.468 | −1.319 | 1535 | .412 | 62884 |
| 74 | 7.49 | −1.294 | 1576 | .407 | 61308 |
| 75 | 7.514 | −1.268 | 2387 | .399 | 58921 |
| 76 | 7.54 | −1.243 | 1652 | .393 | 57269 |
| 77 | 7.569 | −1.218 | 1657 | .387 | 55612 |
| 78 | 7.6 | −1.192 | 1793 | .381 | 53819 |
| 79 | 7.633 | −1.167 | 2386 | .372 | 51433 |
| 80 | 7.668 | −1.141 | 1765 | .366 | 496680 |
| 81 | 7.706 | −1.116 | 1702 | .359 | 47966 |
| 82 | 7.746 | −1.09 | 1848 | .352 | 46118 |
| 83 | 7.789 | −1.065 | 2321 | .344 | 43797 |
| 84 | 7.833 | −1.04 | 1731 | .337 | 42066 |
| 85 | 7.88 | −1.015 | 1696 | .33 | 40370 |

TABLE 1-continued

Spider Arm: Length 60 inches
Bearing Diameter + 1.25 inch
% of Index to Stop = .6
Number of Indexes Per Hour = 1000
Radius of the Geneva = 12 inches
Radius of the Crank = 4.97055809 inches
Crank Centerline To Shaft Centerline = 12.9887046 inches

| CRANK ROTATION | X | Y | INERTIA CHANGE (inch lbs) | INDEXER MOVEMENT (inch) | MOMENTUM (inch lbs$^2$) |
|---|---|---|---|---|---|
| 86 | 7.928 | −.99 | 1996 | .322 | 38374 |
| 87 | 7.979 | −.965 | 2262 | .312 | 36112 |
| 88 | 8.032 | −.94 | 1608 | .305 | 34504 |
| 89 | 8.086 | −.915 | 1571 | .298 | 32933 |
| 90 | 8.143 | −.891 | 2093 | .288 | 30840 |
| 91 | 8.201 | −.866 | 1907 | .279 | 28933 |
| 92 | 8.262 | −.842 | 1565 | .271 | 27368 |
| 93 | 8.324 | −.818 | 1547 | .264 | 25821 |
| 94 | 8.387 | −.794 | 2069 | .253 | 23752 |
| 95 | 8.453 | −.77 | 1612 | .244 | 22140 |
| 96 | 8.52 | −.746 | 1399 | .236 | 20741 |
| 97 | 8.588 | −.723 | 1381 | .228 | 19360 |
| 98 | 8.659 | −.699 | 1932 | .216 | 17428 |
| 99 | 8.73 | −.675 | 1360 | .208 | 16068 |
| 100 | 8.803 | −.652 | 1230 | .2 | 14838 |
| 101 | 8.878 | −.629 | 1195 | .191 | 13643 |
| 102 | 8.954 | −.606 | 1696 | .179 | 11947 |
| 103 | 9.031 | −.583 | 1070 | .171 | 10877 |
| 104 | 9.109 | −.56 | 1032 | .163 | 9845 |
| 105 | 9.188 | −.537 | 1068 | .153 | 8777 |
| 106 | 9.269 | −.514 | 1484 | .14 | 7293 |
| 107 | 9.351 | −.491 | 641 | .134 | 6652 |
| 108 | 9.433 | −.468 | 706 | .126 | 5946 |
| 109 | 9.517 | −.446 | 966 | .116 | 49800 |
| 110 | 9.602 | −.422 | 954 | .104 | 4026 |
| 111 | 9.688 | −.399 | 600 | .096 | 3426 |
| 112 | 9.774 | −.377 | 547 | .088 | 2879 |
| 113 | 9.861 | −.354 | 608 | .078 | 2271 |
| 114 | 9.95 | −.33 | 539 | .068 | 1732 |
| 115 | 10.038 | −.308 | 348 | .068 | 1732 |
| 116 | 10.128 | −.285 | 301 | .054 | 1083 |
| 117 | 10.218 | −.262 | 323 | .045 | 760 |
| 118 | 10.309 | −.24 | 237 | .037 | 523 |
| 119 | 10.4 | −.218 | 146 | .031 | 377 |
| 120 | 10.492 | −.196 | 116 | .026 | 261 |
| 121 | 10.585 | −.175 | 118 | .019 | 143 |
| 122 | 10.678 | −.155 | 58 | .015 | 85 |
| 123 | 10.771 | −.135 | 37 | .011 | 48 |
| 124 | 10.865 | −.116 | 26 | 7E-03 | 22 |
| 125 | 10.959 | −.099 | 16 | 4E-03 | 6 |
| 126 | 11.053 | −.082 | 4 | 2E-03 | 2 |
| 127 | 11.148 | −.067 | 2 | 1E-03 | 0 |
| 128 | 11.243 | −.053 | 0 | 0 | 0 |
| 129 | 11.338 | −.041 | 0 | 0 | 0 |
| 130 | 11.434 | −.03 | 0 | 0 | 0 |
| 131 | 11.529 | −.021 | 0 | 0 | 0 |
| 132 | 11.625 | −.014 | 0 | 0 | 0 |
| 133 | 11.721 | −8E-03 | 0 | 0 | 0 |
| 134 | 11.817 | −4E-03 | 0 | 0 | 0 |
| 135 | 11.913 | −1E-03 | 0 | 0 | 0 |

TABLE 2

Spider Arm: Length 60 inches
Bearing Diameter + 1.25 inch
% of Index to Stop + .5
Number of Indexes Per Hour + 1000
Radius of the Geneva = 12 inches
Radius of the Crank = 4.97055809 inches
Crank Centerline To Shaft Centerline = 12.9887046 inches

| CRANK ROTATION | X | Y | INERTIA CHANGE (inch lbs) | INDEXER MOVEMENT (inch) | MOMENTUM (inch lbs$^2$) |
|---|---|---|---|---|---|
| 69 | 7.407 | −.167 | 286254 | .879 | 286254 |
| 70 | 7.419 | −.076 | 159290 | .585 | 126964 |
| 71 | 7.433 | −.071 | 477 | .584 | 126487 |
| 72 | 7.449 | −.066 | 605 | .583 | 125882 |
| 73 | 7.468 | −.062 | 862 | .581 | 125020 |
| 74 | 7.49 | −.057 | 1052 | .578 | 123968 |
| 75 | 7.514 | −.052 | 2451 | .573 | 121517 |

TABLE 2-continued

Spider Arm: Length 60 inches
Bearing Diameter + 1.25 inch
% of Index to Stop + .5
Number of Indexes Per Hour + 1000
Radius of the Geneva = 12 inches
Radius of the Crank = 4.97055809 inches
Crank Centerline To Shaft Centerline = 12.9887046 inches

| CRANK ROTATION | X | Y | INERTIA CHANGE (inch lbs) | INDEXER MOVEMENT (inch) | MOMENTUM (inch lbs$^2$) |
|---|---|---|---|---|---|
| 76 | 7.54 | −.048 | −403 | .573 | 121920 |
| 77 | 7.569 | −.045 | 1080 | .571 | 120840 |
| 78 | 7.6 | −.041 | 2462 | .565 | 118378 |
| 79 | 7.633 | −.038 | 1731 | .561 | 116647 |
| 80 | 7.668 | −.034 | 2027 | .556 | 114620 |
| 81 | 7.706 | −.031 | 2010 | .551 | 112610 |
| 82 | 7.746 | −.029 | 2598 | .545 | 110012 |
| 83 | 7.789 | −.026 | 2248 | .539 | 107764 |
| 84 | 7.833 | −.024 | 2581 | .533 | 105183 |
| 85 | 7.88 | −.023 | 2608 | .526 | 102575 |
| 86 | 7.928 | −.021 | 2652 | .519 | 99923 |
| 87 | 7.979 | −.02 | 2788 | .512 | 97.35 |
| 88 | 8.032 | −.02 | 2898 | .504 | 94237 |
| 89 | 8.086 | −.019 | 2891 | .496 | 91346 |
| 90 | 8.143 | −.02 | 3063 | .488 | 88283 |
| 91 | 8.201 | −.02 | 3436 | .478 | 84847 |
| 92 | 8.262 | −.021 | 3195 | .469 | 81652 |
| 93 | 8.324 | −.022 | 3235 | .46 | 78417 |
| 94 | 8.387 | −.023 | 3187 | .45 | 75230 |
| 95 | 8.453 | −.025 | 3316 | .44 | 71914 |
| 96 | 8.52 | −.027 | 3290 | .43 | 68624 |
| 97 | 8.588 | −.03 | 3151 | .42 | 65473 |
| 98 | 8.659 | −.033 | 3258 | .41 | 62215 |
| 99 | 8.73 | −.036 | 3353 | .398 | 58862 |
| 100 | 8.803 | −.039 | 3603 | .386 | 55259 |
| 101 | 8.878 | −.042 | 3352 | .374 | 51907 |
| 102 | 8.954 | −.045 | 3085 | .363 | 48822 |
| 103 | 9.031 | −.048 | 3095 | .351 | 45727 |
| 104 | 9.109 | −.052 | 3043 | .339 | 42684 |
| 105 | 9.188 | −.056 | 3012 | .327 | 39672 |
| 106 | 9.269 | −.059 | 2995 | .314 | 36677 |
| 107 | 9.351 | −.063 | 2866 | .302 | 33811 |
| 108 | 9.433 | −.066 | 2685 | .289 | 31126 |
| 109 | 9.517 | −.069 | 3096 | .275 | 28030 |
| 110 | 9.602 | −.072 | 2576 | .262 | 25454 |
| 111 | 9.688 | −.075 | 2452 | .249 | 23002 |
| 112 | 9.774 | −.077 | 2371 | .236 | 20631 |
| 113 | 9.861 | −.079 | 2226 | .222 | 18405 |
| 114 | 9.95 | −.081 | 2099 | .209 | 16306 |
| 115 | 10.038 | −.082 | 2016 | .196 | 14290 |
| 116 | 10.128 | −.082 | 1943 | .182 | 12347 |
| 117 | 10.218 | −.082 | 1951 | .167 | 10396 |
| 118 | 10.309 | −.082 | 1343 | .156 | 9053 |
| 119 | 10.4 | −.08 | 1659 | .141 | 7394 |
| 120 | 10.492 | −.078 | 1378 | .127 | 6016 |
| 121 | 10.585 | −.075 | 1177 | .114 | 4839 |
| 122 | 10.678 | −.072 | 1034 | .101 | 3805 |
| 123 | 10.771 | −.067 | 890 | .088 | 2915 |
| 124 | 10.865 | −.062 | 738 | .076 | 2177 |
| 125 | 10.959 | −.057 | 602 | .065 | 1575 |
| 126 | 11.053 | −.051 | 480 | .054 | 1095 |
| 127 | 11.148 | −.044* | 418 | .042 | 677 |
| 128 | 11.243 | −.037 | 248 | .034 | 429 |
| 129 | 11.338 | −.031 | 181 | .025 | 248 |
| 130 | 11.434 | −.024 | 113 | .019 | 135 |
| 131 | 11.529 | −.018 | 73 | .012 | 62 |
| 132 | 11.625 | −.012 | 39 | 7E-03 | 23 |
| 133 | 11.721 | −&E-03 | 16 | 4E-03 | 7 |
| 134 | 11.817 | −4E-03 | 6 | 1E-03 | 1 |
| 135 | 11.913 | −1E-03 | 1 | 0 | 0 |

This should be contrasted with the data shown in Table 2, in which the same parameters are used except that the wheel has eight straight line, radial Geneva slots 126 such as shown in U.S. Pat. No. 4,099,460 and that 50 percent of the wheel movement occurs during the inward travel of the drive to the inner slot end wall 128 rather than 60 percent wheel movement as described above in connection with Table 1.

It will be seen that the motor size for the straight line Geneva should be higher as the inertia change at crank rotation position 90 is 3.063 inch-pounds versus the 2,093 inch-pounds of inertia change for the curved slot Geneva mechanism of Table 1. Contrasting positions of the crank position 128 in Table 2 with the crank position 128 of Table 1, it will be seen that the indexer crank driver and wheel still have 0.034 inches to travel whereas thet indexer crank driver and wheel for the curved slot mechanism have zero inches to travel showing that travel is already completed. This shows the significantly earlier stopping of the indexer movement which allows the registration mechanism to register even before the roller 32 leaves the slot 26.

Figure 1:
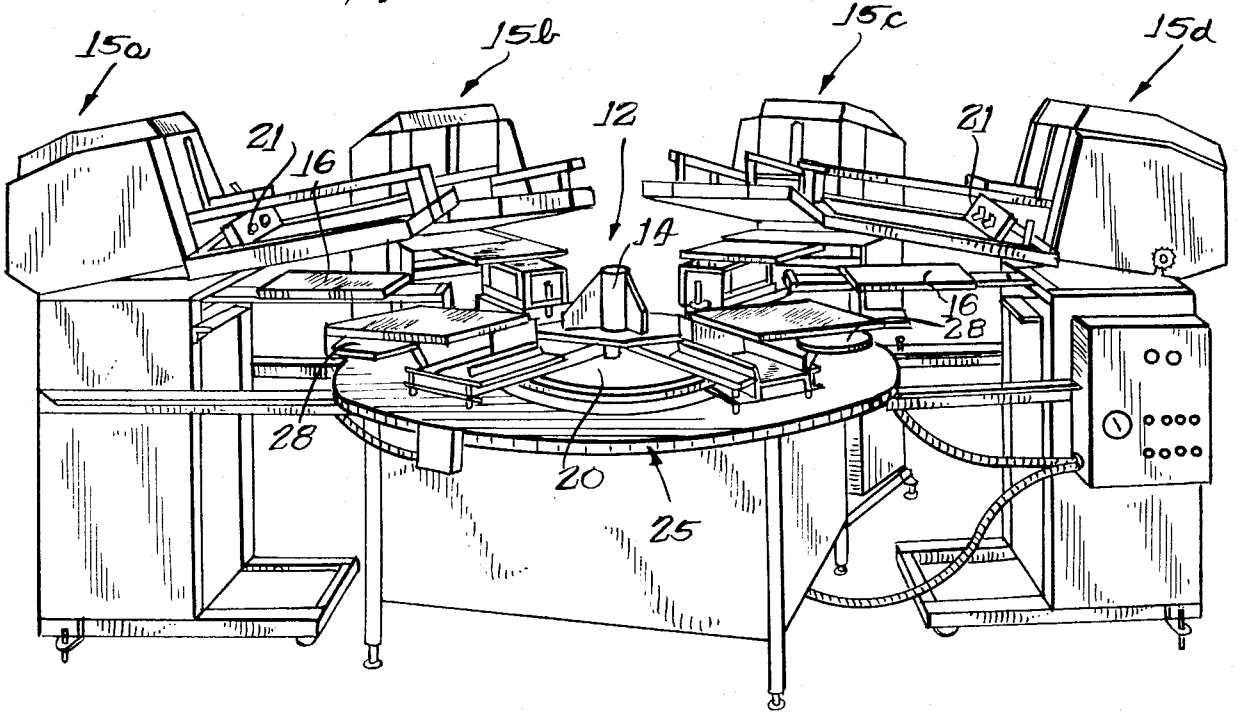
FIG. 1 is a partial view of a multi-color printing apparatus having a turntable movable past screen printing machines.

The illustrated and preferred registering mechanism is that which is described in U.S. Pat. No. 4,099,460 and which comprises a locking fork 66 having a recess 68 to receive the locking pin 64 which is fixed to the turntable 25. The machine illustrated in FIG. 1 is a six color apparatus, with two of the six printing machines being not shown, to allow a better view of the turntable assembly 12. Thus, in the illustrated apparatus of FIG. 1, there will be six locking pins 64 each at 60° increments about the turntable 25. The fork is guided for vertical movement upwardly to the locking position by guide rollers 70. The fork is mounted on the upper end of the vertically movable locking bar 58 which is pivoted at its lower end to an actuating rod 56. The actuating rod 56 is pivoted at its rear end to a pivot pin **56*a* fastened to the base 22. The registering arm is actuated by a vertical arm 54 which carries a cam follower roller 52 which is movable by a cam means 50 which has cam rises 48 and cam falls 46 curved in a manner that the guide rod is lifted as the crank pin reaches position 128** in the Table 1 to provide the early locking and registering without the banging accompanying the use of the straight line Geneva mechanism of the prior art. Manifestly, there may be no registering means used or the registering means may be of various kinds of mechanism such as a detent mechanism and the screen printing apparatus will still fall within the purview of the appended claims.

When the turntable 25 stops at each index location, each of the printing machines is automatically actuated in a conventional manner, as disclosed in the aforementioned patent to begin a screen printing cycle. More specifically, the driver shaft 34 operates a switch means which includes limit switches 40 and 42 controlled by a cam 44 fixed to the shaft 34. The cam 44 has recesses 45 thereon which are followed by cam rollers 41 mounted on each of the switches 40 and 42 to operate the switches when the shaft and cam follower arrive at the termination of the indexing movement. As explained in the aforementioned patent, the operation of the limit switches controls the starting and stopping of the printing machines 15A–15D as well as the starting and stopping of the electric motor to drive the indexer.

From the foregoing, it will be seen that the present invention provides a new and improved curved slot Geneva mechanism for indexing the turntable in a screen printing apparatus. By having more than fifty percent of the total indexing movement occur during the first half of the crank and driver movement into the slot, there is less indexing movement to be made over the last half of the crank and driver movement outward from the slot. Because the slot is curved in the direction of wheel and driver travel, the wheel may have completed its travel before the driver exits the curved slot. This allows more time for stopping and for the engagement of the registering mechanism thereby eliminating the abrupt stopping or jarring often accompanied by the use of straight slot Geneva mechanism in the conventional apparatus.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. In a screen printing apparatus, the combination comprising:

a rotatable turret having a plurality of work supports carried thereon at predetermined equal distances from a central rotational axis for said turret for indexing to each of a plurality of index positions, screen printing means at each of a plurality of index positions for successively printing on the work carried by said supports, motor means for turning the rotatable turret about said rotational axis and through its indexing movements, register menan to register the turret at each of the index positions for registration of successive impressions on the work, a Geneva mechanism for rotating the turret about said rotational axis comprising a driver driven by said motor means and an indexer connected to said turret, and said indexer having a plurality of curved slots therein having surfaces engaged by said driver, said curved slots having a complex, non-radius shape minimizing the maximum inertia and maximizing the available time for deceleration of the rotatable turret, said curved slots having surfaces engaged by said driver to rotate said indexer through a distance different than fifty percent of its angular travel during the driver's inward travel into one of siad curved slots, said driver displacing said indexer and generating a motion in the rotatable turret during its deceleration having the characteristics of a modified sine form, said indexer movable through a distance different than fifty percent of its angular displacement during the outward travel of said driver in said curved slot so that the indexer may decelerate slowly as it moves into a stop position.

2. A screen printing apparatus in accordance with claim 1 in which said driver comprises:

a continuously rotating crank and at least one rotatable pin on the crank to engage the surfaces of the curved slot and said indexer comprises a wheel with a plurality of said curved slots therein.

3. An apparatus in accordance with claim 2 in which the pin engages curved walls in said slot throughout the travel of said pin.

4. A screen printing apparatus in accordance with claim 1 in which a plurality of spaced arms are provided on the turret each carrying a platen and in which said registration means comprises a plurality of stop pins fixed to the turret at equiangular positions and further comprises fork means to engage one of said pins to stop the turret and to register the arms prior to the driver leaving the deceleration section of the curved slot.

5. An apparatus in accordance with claim 1 including a gear box mechanism between said motor means and said driver and in which said torque applied to said gear box by said driver engaging the acceleration section is greater than for a straight line slot.

6. An apparatus in accordance with claim 1 in which said an inner end wall of said curved slots is displaced in the trailing direction of indexer movement from an inlet end to said curved slot.

7. An apparatus in accordance with claim 1 in which said curved slot is generated to provide a given displacement of turret for each predetermined increment of movement of the driver through said curved slot.

8. An apparatus in accordance with claim 1 in which said driver slot has its inlet end located forwardly in the direction of indexer travel when the driver is fully inserted into one of said curved slots.

9. An apparatus in accordance with claim 1 in the registration means includes a cam and a fork lifted by the cam and in which said fork is raised to the stop position at about 8° from the driver leaving the curved slot.

10. A method of screen printing comprising the steps of:

placing a workpiece on a platen of a rotatable turntable, rotating the turntable about a rotational axis using a Geneva mechanism by a driver in a curved slot in an indexer connected to said turntable and driving the turntable through a distance different than fifty percent of its angular travel during the inward travel of a driver within the curved slot, controlling the inertia of the turntable by minimizing the maximum inertia and maximizing the available time for deceleration of the turntable, decelerating the turntable by the driver during its withdrawal form the curved slot and rotating the turntable through a distance different than fifty percent of its displacement during the outward travel of said driver in said curved slot and generating a motion in the rotatable turret during its deceleration having the characteristics of a modified sine form to bring the turntable slowly to a dead stop, registering the turret and the platen thereon with the workpiece below a screen printing apparatus, initiating a screen printing operation automatically after coming to the dead stop at a first printing station, repeating the displacing and registering steps for each of a plurality of other printing stations and screen printing on the workpiece at each of said other status, and removing the workpiece from the platen after passing through each of said printing stations.

* * * * *

UNITED STATES PATENT AND TRADEMARK OFFICE

CERTIFICATE OF CORRECTION

PATENT NO. : 4,724,760

DATED : February 16, 1988

INVENTOR(S) : Henry J. Bubley

It is certified that error appears in the above-identified patent and that said Letters Patent is hereby corrected as shown below:

Column 1, Line 31, Change "movement" to --movements--

Column 1, Line 51, Change "os" to --of--

Column 2, Line 7, Change "wil" to --will--

Column 3, Line 68, Change "varible" to --variable--

Column 4, Line 7, Change "dirve" to --drive--

Column 4, Line 54, Change "wal" to --wall- (second occurrence)

Column 5, Line 7, Change "wil" to --will--

Column 6, Line 16, Change "samaple" to --sample--

Column 6, Line 27, Change "eall" to --wall--

Column 10, Line 63, Change "3.063" to --3,063--

Column 12, Line 17, Change "menan" to --means--

Column 12, Line 32, Change "siad" to --said--

Signed and Sealed this

Eighteenth Day of October, 1988

*Attest:*

DONALD J. QUIGG

*Attesting Officer*

*Commissioner of Patents and Trademarks*